United States Patent [19]

Romagnoli

[11] Patent Number: 5,070,681

[45] Date of Patent: Dec. 10, 1991

[54] MACHINE FOR PACKAGING PRODUCTS IN GENERAL BY PRODUCING CASES OR BOXES OF THE HINGED-LID TYPE WHICH CAN BE CLOSED OVER A COLLAR WITH A GUARANTEE SEAL STARTING FROM INDIVIDUAL FLAT BLANKS WITH MULTIPLE COMPONENT PARTS

[75] Inventor: Andrea Romagnoli, San Lazzaro di Savena, Italy

[73] Assignee: Cestind - Centro Studi Industriali s.r.l., San Pietro Terme, Italy

[21] Appl. No.: 598,180

[22] Filed: Oct. 15, 1990

[30] Foreign Application Priority Data

Nov. 7, 1989 [IT] Italy ..... 3687 A/89

[51] Int. Cl.[5] ..... B65B 5/02

[52] U.S. Cl. ..... 53/566; 53/579

[58] Field of Search ..... 53/456, 558, 563, 566, 53/575, 579

[56] References Cited

U.S. PATENT DOCUMENTS 3,673,763 7/1972 Dorfmann ..... 53/209 X 3,821,874 7/1974 Jones ..... 53/252 X 4,525,977 7/1988 Matt ..... 53/550 X 4,890,440 1/1990 Romagnoli ..... 53/456

*Primary Examiner*—John Sipos

*Attorney, Agent, or Firm*—Herbert Dubno; Yuri Kateshou

[57] ABSTRACT

A machine for packaging products by producing boxes of the hinged-lid type which can be closed over a collar with a guarantee seal starting from individual flat blanks with multiple component parts formed by three operationally independent machine sections of modular structure interconnected in the overall machine in an operationally interdependent manner. A first machine section includes an apparatus utilizing a static separation for the supply of the individual blanks in individual sequence to the second machine section comprising a closed-loop conveyor provided with gripper members for supplying the individual blanks to successive stations so that they can be made up in a tubular shape and for transferring them to the third machine section for the operations to fill them with the product to be packaged and their closure with the guarantee seal.

4 Claims, 4 Drawing Sheets

MACHINE FOR PACKAGING PRODUCTS IN GENERAL BY PRODUCING CASES OR BOXES OF THE HINGED-LID TYPE WHICH CAN BE CLOSED OVER A COLLAR WITH A GUARANTEE SEAL STARTING FROM INDIVIDUAL FLAT BLANKS WITH MULTIPLE COMPONENT PARTS

FIELD OF THE INVENTION

The present invention relates to a machine for packaging products by producing boxes or cases particularly of the hinged-lid type which can be closed over a collar with a guarantee seal starting from individual flat blanks with multiple component parts.

BACKGROUND OF THE INVENTION

The applicants for this Patent Application have disclosed, in their prior Italian Patent Application 3577 A/87 filed on July 29, 1987 (U.S. Pat. No. 4,890,440), a method for the production of boxes or cases of the so-called hinged-lid type which can be closed over a collar with a guarantee seal for the packaging of products in general and in particular foodstuffs, domestic products such as detergent powders, pharmaceuticals and the like starting essentially from individual flat blanks with notches, fold lines and separation lines defining the panels and flaps for the production of the box body and the lid body for the closure of these cases or boxes with guarantee seals so as to be able to carry out this method automatically by means of a particularly simple machine with a high unit production time and of relatively economic cost with respect to conventionally known machines.

Flat blanks in the form of a single member or piece for packaging bottles, cans and the like are already known for the production of multiple-compartment cartons in which, during the packaging or production of these multiple-compartment cartons from these individual blanks, a portion is separated from a part of the blank designed to form the box body or outer container, this portion being designed to form an inner dividing member for the box body with the sole aim of reinforcing the lateral walls of these cartons against the outward swelling which takes place in response to the thrust exerted by the products already packaged therein particularly during the stages of movement for loading and unloading during transportation and for the use of the products (see for instance the U.S. Pat. Nos. 2,854,181, 3,106,876, 3,153,453, 3,135,454, 3,185,047 and 3,185,048).

In the field of packaging or wrapping of tobacco products such as cigarettes and the like it is also known to use cases or boxes of the hinged-lid type which can be closed over an inner member shaped as a collar which are known as cigarette hard packs.

These inner collar members are produced by the same packaging machine and are obtained from a spool of cardboard strip by cutting operations and transfer to the packet or box production line of the packaging machine, preparing them for use in combination with the blank forming the box body along the production line for the box itself (see for instance U.S. Pat. Nos. 3,972,271 and 3,967,543). In practice a line of this type for the production of this type of packet or box with a collar is very complex and consequently costly and is therefore economically expensive both as regards the production of these packaging machines, particularly for cigarettes, and as regards their maintenance and is not therefore advantageous for the production of boxes or packets designed to package products other than cigarettes, for instance the products listed above by way of example.

Following on from the prior art discussed above, the method disclosed in the above-mentioned Italian Patent Application 3577 A/87 filed on July 29, 1987 (U.S. Pat. No. 4,890,440) by the applicants and entitled "Method for the production of packaging cases and packaging cases obtained by this method" which starts from individual flat blanks provided with notches, fold lines and separation lines defining the panels and flaps for the production of the box body and the lid body for the closure of the boxes or cases with guarantee seals is essentially characterized in that it comprises a sequence of stages comprising the individual supply of these flat blanks with multiple component parts, the separation of a portion from these individual flat blanks being supplied in sequence along the relative separation line and the application of this portion to the individual flat blanks in order to form the corresponding collar of the box being produced, the folding about the respective fold lines of these flat blanks and the gluing of the respective flap so that they can be formed with a tubular shape in order to contain the product(s) to be packaged and the folding of the flaps for the production and closure of the opposite ends or heads and their gluing to provide boxes of the type with a collar and a guarantee seal closure for the products contained therein at the respective separation line.

Further characteristics of the above method lie in that a stage of relative movement between the flat blank and the corresponding collar portion is provided before they are joined and in that this relative movement between the flat blank and the corresponding collar portion takes place in the respective plane of one and/or the other and in one and/or the other of two directions perpendicular to one another.

Among other things, one of the objects of the method disclosed in the above-mentioned Patent Application 3577 A/87 (U.S. Pat. No. 4,890,440) is that, as disclosed in the text of the description attached to this prior application, of allowing the method according to the above objects to be implemented automatically by means of a particularly simple intermittently or continuously moving machine with a high unit production time whose cost is relatively economic in comparison with the results that can be achieved therewith.

OBJECT OF THE INVENTION

It is, therefore, the main object of the present invention to provide a particularly simple machine of this type with a high unit production time, whose cost is relatively economic, of the intermittently moving type.

SUMMARY OF THE INVENTION

The present invention therefore relates to a machine for packaging products in general by producing boxes or cases particularly of the hinged-lid type which can be closed over a collar with a guarantee seal starting from individual flat blanks provided with notches, fold lines and separation lines defining walls and flaps for the production and closure of the boxes, which packaging machine is substantially characterized in that it comprises three operationally independent machine sections with a modular structure interconnected in the overall machine in an operationally interdependent manner, in that a first machine section comprises an apparatus with substantially static separation means for the supply of the individual flat blanks stacked sideways in a store with a high storage capacity in individual rhythmic sequence, in that the second machine section comprises closed-loop conveyor means provided with uniformly spaced gripper members for receiving the individual blanks in a flat position in rhythmic sequence from the supply apparatus and for supplying the blanks in sequence to a plurality of operating stations monitoring their suitability for production as a corresponding box or case and folding them into a tubular shape with or without one end closed and in that the third machine section comprises closed-loop conveyor means correspondingly provided with uniformly spaced gripper means for receiving the cases or boxes previously made up in a tubular shape with or without one end closed in sequence from the conveyor means forming the second machine section so that they can be filled with the product to be packaged and the opposite ends of these cases or boxes can be closed with a seal.

A further important characteristic feature of the packaging machine in question lies essentially in that it is possible to provide a machine with modular units which can be operationally interconnected so that it is possible, when the physical or organoleptic properties of the material to be packaged vary, to replace one or more of the three machine sections in the overall machine, especially the third section, thereby adapting it to the particular type of material to be packaged within these boxes or cases which can be closed over a collar with a guarantee seal.

A further important characteristic feature of the packaging machine in question lies in the possibility, in particular in respect of the third machine section, of being able to adjust it as a function of changes of format, i.e. of the dimensions of the case or box containing the product to be packaged, without having to change details known in the jargon as "format details".

BRIEF DESCRIPTION OF THE DRAWING

Further advantages, features and characteristics of the packaging machine of the present invention will be more readily apparent the following detailed description with reference to the accompanying drawing, in which.

SPECIFIC DESCRIPTION

As mentioned above, the ultimate aim of the present invention is to provide a machine with modular units for the packaging of products in general in cases or boxes particularly of the hinged lid type which can be closed over a collar with a guarantee seal starting from individual flat blanks with multiple component parts defined by separation lines. A single blank of flat cardboard with multiple component parts substantially comprises, defined by longitudinal and transverse fold lines and notches, a plurality of panels and flaps designed substantially to form the box body and the lid body and by separation lines for a separable part designed to form the collar member and a guarantee seal for the lid body (see for instance the above-mentioned Italian Patent Application 3577 A/87 filed on July 29, 1987 (U.S. Pat. No. 4,890,440) which is intended to allow the possibility of providing a packaging machine intended to implement the method of the U.S. Pat. No. 4,890,440.

By way of example, a packaging machine as previously envisaged and now embodied forming the subject matter of the present invention comprises, as mentioned above, three machine sections (see FIG. 1) with a modular structure which are operationally independent and interconnected in the machine assembly in an operationally interdependent manner.

The first of these machine sections is formed by an apparatus for the supply in individual rhythmic sequence of the individual flat blanks of the type with substantially static means for separating these blanks which are stacked sideways in a store which is inclined downwards in a downstream direction with a high storage capacity which is designated overall by 1 and forms the subject matter of the patent application Ser. No. 07/598,181 filed on the same date as this application in the name of the applicants. A second machine section, designated by 2, comprises closed-loop conveyor means provided with uniformly spaced gripper means for receiving the individual blanks in a flat position in individual rhythmic sequence from the supply apparatus 1 and transporting them in sequence to a plurality of operating stations so that their suitability for production as a corresponding box or case can be checked and they can be folded in a tubular shape with or without one end closed and forms the subject matter of a further patent application Ser. No. 07/598,176 also filed on the same date as this application in the name of the applicants. The third machine section, designated by 3, also comprises closed-loop conveyor means correspondingly provided with uniformly spaced gripper members for receiving the cases or boxes formed into a tubular shape with or without one end closed in sequence from the conveyor means forming the second machine section 2 so that they can be filled with the product(s) to be packaged and the opposite end(s) or head(s) of the corresponding boxes or cases can be closed with a guarantee seal.

Figure 1:
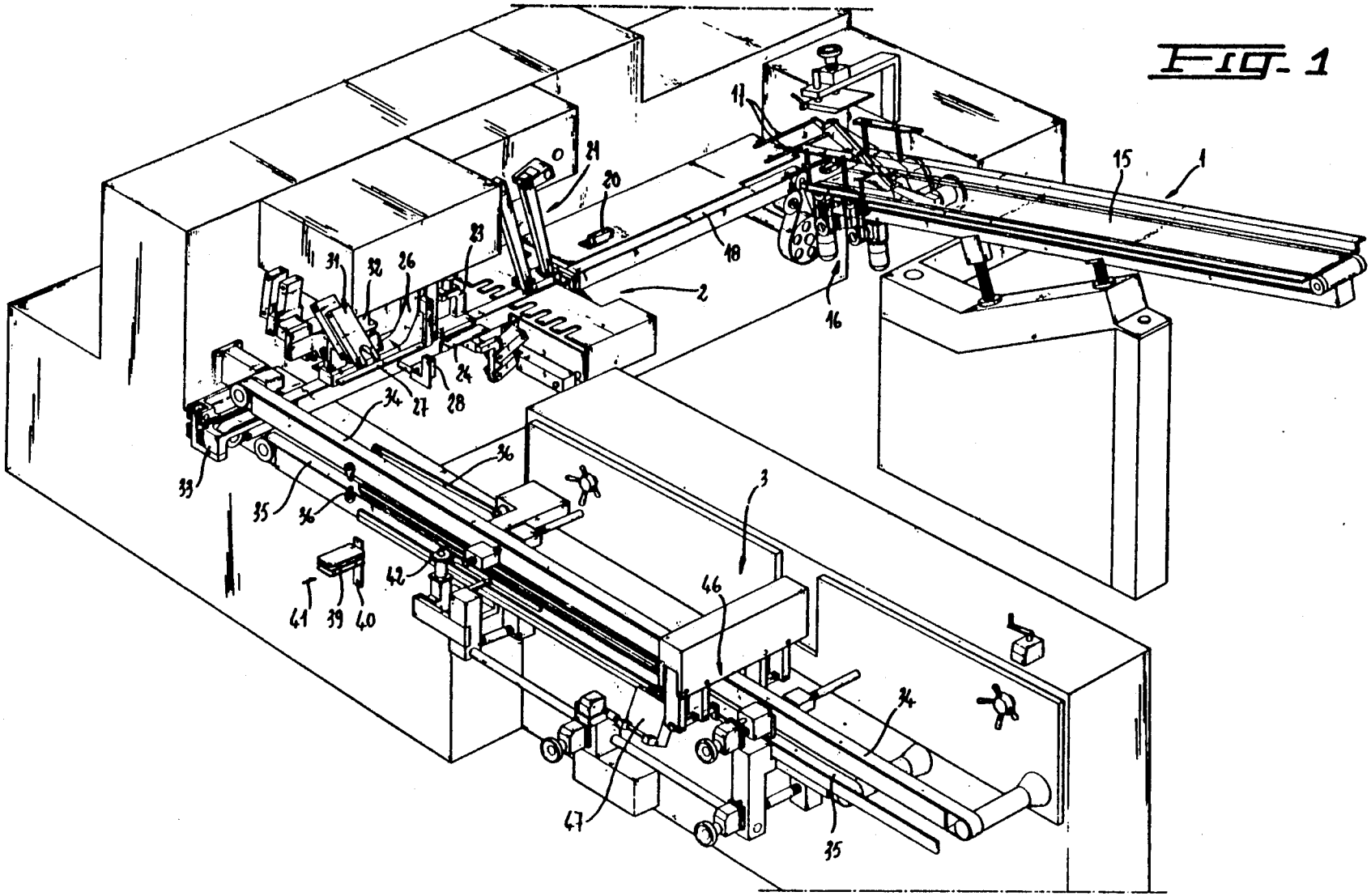
FIG. 1 is a perspective view of this packaging machine, looking from the top from the viewpoint of the operator.

The modular machine sections 1, 2 and 3 which are operationally independent but functionally interconnected in an interdependent manner in the machine assembly of FIG. 1 are disposed by way of example, as mentioned above, to form a "U" when looked at from above from the viewpoint of the operator.

Figure 7:
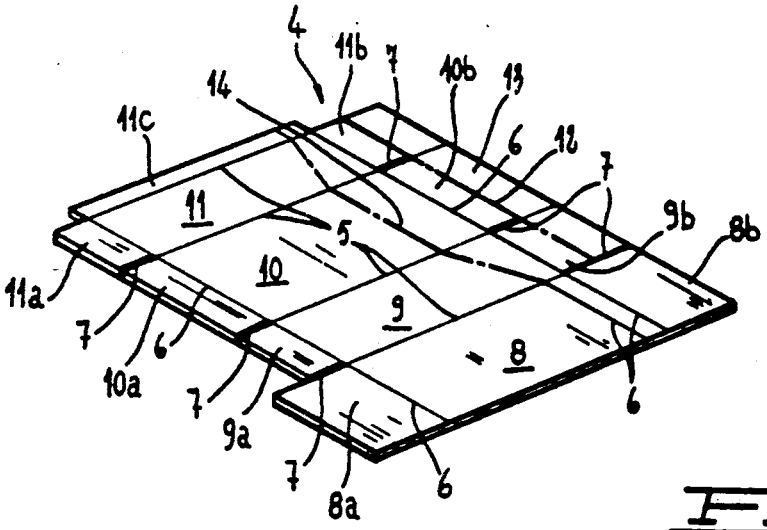
FIG. 7 shows the structure of a flat multiple-section blank which can be used in the packaging machine of FIG. 1 for the production of the case or box with a collar for the lid with a guarantee seal.

In the embodiment shown in the attached drawings of the machine with modular components or machine sections, use is made of a flat cardboard blank with multiple component parts indicated overall by 4 (see FIG. 7 in particular) in which the lateral walls 8, 9, 10 and 11 and the production and closure flaps 8*a*, 8*b*, 9*a*, 9*b*, 10*a*, 10*b* and 11*a*, 11*b* and 11*c* of the box are defined by longitudinal and traverse fold lines 5 and 6 respectively and notches 7 and, for the reasons mentioned above which will be explained in detail below, with separation lines, wherein line 12 defines the part designed to form the collar member 13 and line 14 forms the tear-off guarantee seal between the box body and the lid body.

A flat blank 4 of this type is supplied to the machine of the present invention by the first machine section 1, for instance by the above-mentioned supply apparatus disclosed in the patent application Ser. No. 07/598,181, and to the second machine section 2 for its formation as a tubular box of the type disclosed, for instance, in the further patent application Ser. No. 07/598,176 and the box in this tubular shape is transferred from the second machine section 2 to the third machine section 3 so that it can be filled with the product to be packaged and so that the box can be closed with a guarantee seal.

Figure 5:
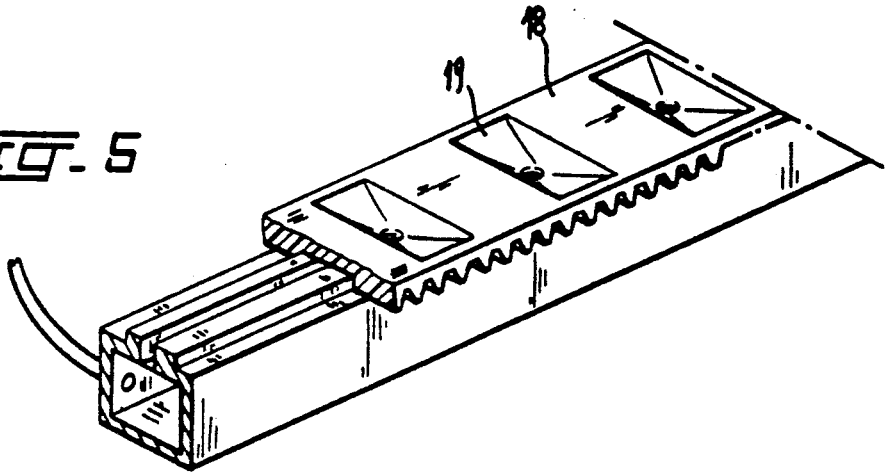

In accordance with the above-mentioned patent application Ser. No. 07/598,181 the blanks 4 stacked sideways in a store 15 with a high storage capacity which is inclined downwards in a downstream direction are first caused to advance in groups, under control, by a divider device designated overall by 16 (see in particular FIG. 1 and in a very diagrammatic way FIG. 2 as well as the patent application Ser. No. 07/598,181) so as to take them from the load of the overall stacked column and are then taken from these groups in individual sequence by suction cup means 17 and deposited in a flat horizontal position on the closed-loop conveyor means 18 with gripper means 19 (see FIG. 5) which are explained in detail below and form the second machine section 2 disclosed in the above-mentioned patent application Ser. No. 07/598,176 (see FIG. 2). This conveyor 18 is moved intermittently or in successive steps, i.e. with a feed movement followed by a pause for the checking operations and the folding operations to form the flat blanks 4 into boxes, wherein each pause corresponds to a operating station and therefore the position in which these flat blanks 4 are deposited on the conveyor 18 is defined as station I.

By means of an intermittent movement or successive step of the conveyor 18 the blank 4 received at station I is caused to advance to station II (see FIG. 2) in which means 201 check whether it is whole and whether or not it is suitable for production as a box or whether it should be rejected, again by known means, and replaced by a suitable blank. By means of a further intermittent movement or successive step the blank 4 is advanced to a non-operative station III, downstream of which and prior to station IV there is disposed a photocell 20 (see FIG. 1), the reasons for which will be explained below. By means of a further intermittent movement or successive step, the blank 4 is conveyed from station III to station IV where, by means of an articulated quadrilateral device shown overall by 21 (see FIG. 1) and following the detection of the presence or absence of the blank 4 by the photocell 20, the component part 13 of the blank designed to form the collar of the box being produced is separated along the separation line 12 and is re-applied, by a relative movement between the collar portion 13 and the blank portion 4 and the spraying of glue by the gluing device 22 (see FIG. 2) controlled by the photocell 20, to the blank 4 along the separation edge for the removal of this collar member 13. By means of a further intermittent movement or successive step the blank 4 provided in this way with the collar member 13 is advanced from station IV to station V where, by means of the counter-folding means 23 and folding means 24 and 25 (see FIG. 3 in particular) actuated with an alternating vertical movement, the walls 9, 8 and 11 and the flap 11*c* with the associated flaps 9*a*, 9*b*, 8*a*, 8*b* and 11*a*, 11*b* are folded vertically upwards about the respective longitudinal fold lines 5 (see FIG. 2). Following a further intermittent movement or successive step, the blank 4 provided with the collar member 13 and folded in this way is supplied to station VI where its wall 10 and associated flaps 10*a* and 10*b* pass below a counter-folding core member 26 with the walls 9, 8 and 11 and the flap 11*c* with the associated flaps 9*a*, 9*b*; 8*a*, 8*b* and 11*a* and 11*b* held in a vertical position by guide means 27 against the longitudinal flanks of this counter-folding core member 26 (see FIGS. 1 and 3). At station VI (see FIGS. 1 and 2), following detection via the photocell 28 of the presence of the blank 4 with the corresponding collar member 13 being produced, it is sprayed by gluing means 29, controlled by the photocell 28, with glue on the outer surface of the packaging flap 11*c* and the latter, sprayed with glue in this way, is folded onto the upper surface of the counter-folding core means 26 by comb folding means 30, while, by means of the articulated quadrilateral folding device shown overall by 31 (see FIG. 1), the panel or wall 8 is folded against this upper surface of the counter-folding core means 26 behind the packaging flap 11*c* (position a of station VI) and is held there by a pressure member 32 with an alternating vertical movement (position b of station VI) (see FIG. 2 in particular).

Figure 4:
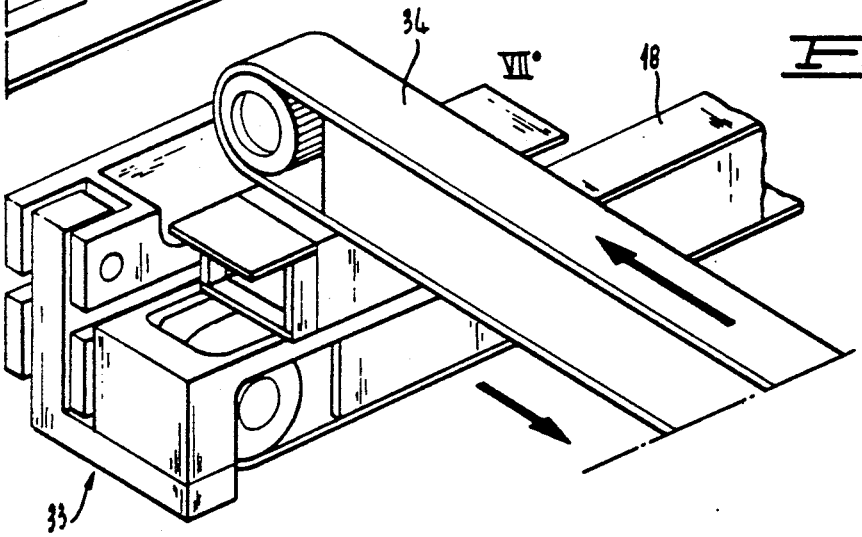

The box being produced and folded into a tubular shape in this way at station VI is supplied, via a further intermittent movement or successive step of the conveyor belt 18, to station VII where, by means of means with an alternating vertical movement shown overall by 33 (see FIGS. 1 and 4) and disclosed in the above-mentioned patent application Ser. No. 07/598,176 it is transferred while being held by suction to a closed-loop conveyor 34 which forms the third machine section 3 in association with a conveyor 35 disposed vertically therebelow.

As mentioned above, in this third machine section 3, formed substantially by the closed-loop conveyors 34 and 35 provided with uniformly spaced gripper means in a similar manner to the conveyor 18 of the second machine section 2, the boxes formed into a tubular shape in the second machine section 2 are supplied with the products to be packaged and the opposite ends or heads of the corresponding boxes or cases are closed with a guarantee seal. The conveyors 34 and 35 are also moved intermittently or in successive steps in phase synchronization with the conveyor 18 of the second machine section 2, wherein each pause corresponds to a potential operating station in this machine section 3 as well.

Figure 2:
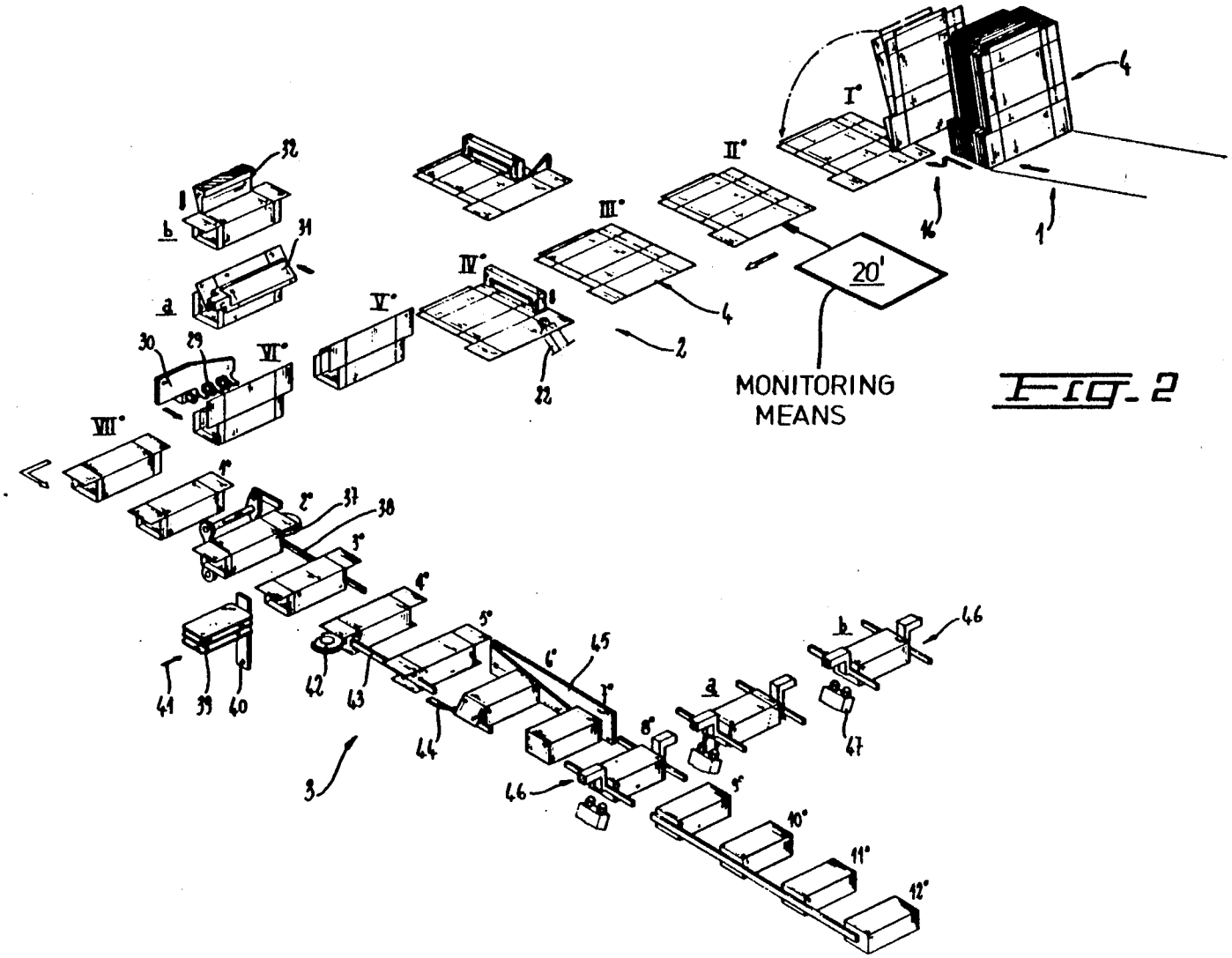
FIG. 2 is a perspective view similar to FIG. 1 of a sequence of operating stages for the production of the cases or boxes in question from the supply of the respective blanks to the closure of these same cases or boxes for packaging a particular product with a guarantee seal.
Figure 3:
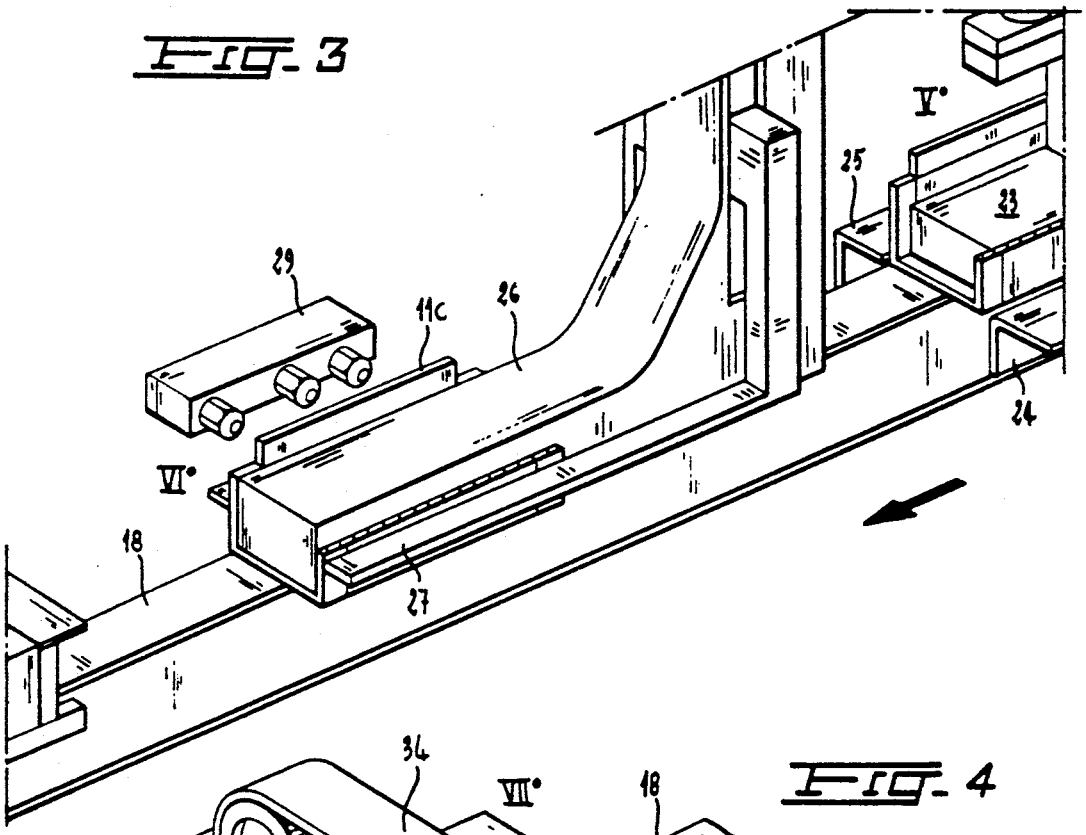
FIGS. 3, 4 and 5 are perspective views of three details on an enlarged scale showing the movement of the blanks in the packaging machine of FIG. 1 for their production or packaging as corresponding cases with guarantee seals.
Figure 6:
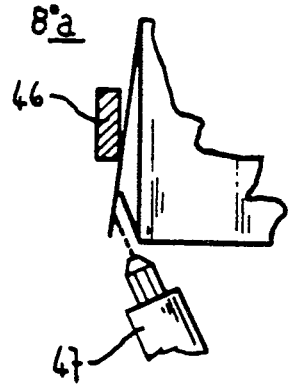
FIG. 6 shows a detail relating to a closure of the lid with the guarantee seal in question.

The box being produced and transferred at station VII of the machine section 2 to the closed loop conveyor 34 of the third machine section 3 is advanced by a step by this conveyor and caused to pause at the first station of the third machine section 3 and supported by suction on the underlying conveyor 35 (see FIGS. 1 and 2). During a subsequent step of the conveyors 34 and 35 from the first to the second station the box, ready to be filled with the product to be packaged, is positioned and step adjusted by means 36 with an alternating movement in the second station with its flaps 11*b* and 9*b* folded towards the interior of the tube by rotary and fixed folding means 37 and 38 respectively. By means of a subsequent intermittent movement or step of the conveyors 34 and 35 the box in question is caused to pause at the third station where a specific product 39 with an associated printed leaflet 40 containing information on and instructions for the use of the product are inserted into the box pausing at this third station by known insertion means (see arrow 41 in FIG. 2). The box containing the product to be packaged is then moved from this third station by an intermittent movement or successive step to a fourth station which it reaches with its flaps 11*a* and 9*a* folded towards its interior by rotary and fixed folding means 42 and 43 respectively. The box is then supplied by a further intermittent movement from the fourth station to a non-operative fifth station and then by a further intermittent movement to a sixth station which it reaches with its flaps 10*a*, 10*b* and 8*a*, 8*b*, folded upwards and downwards respectively by a pair of upper 44 and lower 45 helical folding means in a mirror image arrangement and therefore with these flaps in the closed position as shown at the subsequent seventh station. By means of a further intermittent movement or successive step the box in the closed position is supplied from the seventh station to an eighth station at which there are provided means, designated overall by 46, intended to slacken the pressure on the flaps 8*a* and 8*b* as shown at position a of this eighth station so that glue can be sprayed by gluing means 47 between the flaps 8*a*, 10*a* and 8*b*, 10*b* and pressure can then be exerted on the flaps 8*a* and 8*b* as shown at position b of this eighth station (see FIGS. 1, 2 and 6) thereby sealing the box. In this position the sealed box is supplied in sequence through the ninth, tenth, eleventh and twelfth stations for consolidation in this sealed position and subsequent collection as a finished product.

The description of the packaging machine in question made with reference to the attached drawings in obviously given solely by way of example and it is therefore evident that any modifications and variants suggested by practice and by its embodiment and use can be made thereto without departing from the scope of the following claims.

I claim:

1. A machine for packaging products in a hinged-lid type boxes to be erected and closed over a collar with a guarantee seal, said machine comprising:

a first machine module formed with an end and including:

first driving means for driving a first closed-loop elongated conveyor inclined to a horizontal and transporting a plurality of flat blanks toward said end of the first machine module, each of said blanks being formed with notches, fold and separation lines defining walls, ends and flaps of a respective hinged-lid box to be erected along a blank path of said blanks;

storing means close to the end of said first conveyor for storing said plurality of blanks arranged upright side by side to form a bundle thereof, separating means downstream of said storing means for separating each of said blanks from said plurality in an individual rhythmic sequence;

a second machine module formed with respective first and second ends and including:

second driving means for driving horizontally a second closed-loop elongated conveyor extending at an angle from said first conveyor downstream of said separating means and between said first and second ends of the second module, said separating means depositing each of said blanks horizontally flat on said second conveyor positioned to receive each of said blanks in said individual rhythmic sequence and to transport said blanks toward said second end of the second module, a plurality of first gripper members on said second conveyor formed uniformly spaced from one another along said blank path, a plurality of shaping members receiving a respective one of said flat blanks in said rhythmic sequence from said first gripping members for folding respective sides and flaps of the respective blank thereby applying a tubular shape of the respective box to be erected with at least one of the respective ends thereof left open; and a third machine module formed with a respective pair of first and second ends and including:

third driving means for driving a third closed-loop elongated conveyor transporting each of said boxes received in said rhythmic sequence from said second conveyor between the first and second ends of said third module and extending at an angle to said second conveyor, second gripping members spaced uniformly from one another along said box path on said third conveyor, loading means for receiving a respective one of said boxes in said rhythmic sequence from said second gripping members for filling each of the boxes with a product to be packaged, and sealing means downstream of said loading means for sealingly closing the end left open of the respective one of said boxes, said modules forming a U-shaped assembly.

2. The machine defined in claim 1 wherein said second machine module, comprises monitoring means for rejecting defective blanks.

3. The machine defined in claim 1 wherein said second and third conveyors are movable intermittently in a phase synchronization with one another.

4. The machine defined in claim 1 wherein said second machine modulus, further comprising means for gluing adapted to glue respective sides of a respective one of said blanks in response to a signal received from a respective photocell.

* * * * *